US005938031A

United States Patent [19]

Woods

[11] Patent Number: 5,938,031

[45] Date of Patent: Aug. 17, 1999

[54] STORAGE CONTAINER FOR ADVANCED PHOTO SYSTEM FILM CANISTERS AND INDEX PRINTS

[75] Inventor: Carey P. Woods, Plum City, Wis.

[73] Assignee: Richard S. Werner, West Bend, Wis.

[21] Appl. No.: 08/803,038

[22] Filed: Feb. 19, 1997

[51] Int. Cl.[6] ..... B65D 73/00

[52] U.S. Cl. ..... 206/455; 206/425; 206/468; 220/345.1

[58] Field of Search ..... 206/455, 391, 206/564, 425, 468, 471; 220/345.1, 345.2, 345.3

[56] References Cited

U.S. PATENT DOCUMENTS

| | | | |
|---|---|---|---|
| 1,296,423 | 3/1919 | Neef | 220/345.2 |
| 2,472,582 | 6/1949 | Green | 220/345.2 |
| 2,941,664 | 6/1960 | Palmer | 206/461 |
| 2,975,889 | 3/1961 | Brown | 206/468 |
| 3,630,344 | 12/1971 | Bergh | 220/345.2 |
| 4,071,286 | 1/1978 | Moyer | 206/455 |
| 4,366,903 | 1/1983 | Gaiser et al. | 206/455 |
| 4,375,850 | 3/1983 | Smyth et al. | 206/471 |
| 5,251,747 | 10/1993 | Hansen et al. | 206/455 |
| 5,299,688 | 4/1994 | Mckay et al. | 206/425 |
| 5,429,245 | 7/1995 | Tanibata | 206/564 |
| 5,609,252 | 3/1997 | Koch | 206/455 |
| 5,704,472 | 1/1998 | Werner et al. | 206/455 |

*Primary Examiner*—Paul T. Sewell
*Assistant Examiner*—Nhan T. Lam
*Attorney, Agent, or Firm*—Jansson, Shupe, Bridge & Munger, Ltd.

[57] ABSTRACT

A tray for storing a container housing a film cartridge used in the Advanced Photo System is disclosed. The container has a rectangular, flat card member with a box-like blister member attached thereto for holding the film cartridge. The tray has a pair of retention members configured as a pair of parallel guide slots for sliding engagement with the container edges. A barrier at one end of the tray limits sliding movement of such container with respect to the tray. A new storage chest for holding multiple containers and a new method for making a tray are also disclosed.

9 Claims, 4 Drawing Sheets

STORAGE CONTAINER FOR ADVANCED PHOTO SYSTEM FILM CANISTERS AND INDEX PRINTS

FIELD OF THE INVENTION

This invention relates to storing and protecting film containers and photographic prints in general, and more specifically, to storing and protecting film containers and photographic prints used with the Advanced Photo System.

BACKGROUND OF THE INVENTION

The Advanced Photo System ("APS") is a new process in the field of photography. With the APS, information regarding the film speed, emulsion details and photograph length are magnetically recorded on the film. When a photograph is being taken, the camera "reads" or detects the information on the film and, if appropriate under the circumstances, automatically adds exposure information to correct for lighting errors. These corrections result in better photo-finishing.

Using the APS, a photographer will be able to preselect the size of the finished photographic print prior to taking the photo. This feature will allow an individual to take photos of differing sizes using the same roll of film.

Print information is digitized on the film and the developed film is stored in the film canister in which such film was originally purchased. As a result, the consumer will no longer be receiving the familiar film strips, commonly called "negatives." Instead, APS users will be provided with an index card—much like a proof sheet—along with their printed photographs. The index card will show miniversions of all of the photo exposures on a particular roll of film. Because the developed film will be returned in its original canister, a new device is needed that will allow the consumer to conveniently store the film canister and index print together in an organized manner. At least one reason such convenience is desirable is so that when ordering additional prints, the proper film canister to return for additional processing, i.e., production of additional prints, can quickly and accurately be identified.

Given the diminutive size and cylindrical shape of the APS film canister, most consumers will likely find it cumbersome to store their flat, sheet-like photographs together with the canister. To put it in other words, there is a high probability that the film canister will become separated not just from its photographs, but more importantly from its flat, sheet-like index print as well. Several canisters may become co-mingled thus making it difficult to identify which film canister was used to generate a particular photograph or set of photographs.

Because the index print that is returned along with the APS canister is the only way to identify which photographs are digitized in the canister, it is very important that such index print and canister—and only a single index print and its matching canister—be stored together. Therefore, an apparatus that would allow an individual to store several APS film canisters and their respective index prints in an organized manner would be an important advancement in the art.

OBJECTS OF THE INVENTION

An object of the invention is to provide an apparatus for storing film canisters and index prints associated with the APS system.

Another object of the invention is to provide an apparatus for storing of film canisters and index prints associated with the APS system that allows easy review of an index print associated with a particular film canister.

Still another object of the invention is to provide an apparatus that facilitates organized storage of several APS film canisters and their respective index prints.

Another object of the invention is to provide a method for manufacturing an apparatus used to store film canisters and index prints associated with the APS system. How these and other objects are accomplished will become apparent from the following descriptions and from the drawings.

SUMMARY OF THE INVENTION

The invention involves a tray for storing a container that is used to confine and store a film cartridge of the type used in the Advanced Photo System. The tray is comprised of a plurality of retention members that allow for sliding engagement of the tray with the container, and the tray also has a barrier for limiting sliding movement of such container with respect to the tray. A particular embodiment of the tray is configured to store a container having a flat, rectangular card member and a blister member affixed thereto to form what may be termed a "blister pack." The two long, parallel edges of the container engage respective retention members for container storage.

In a preferred embodiment of the invention, the tray has a longitudinal axis and the card member has a width and a length, the latter measured parallel to the tray's longitudinal axis. The blister member has a length and a width, and the length of the card member is greater (preferably, substantially greater) than the length of the blister member.

In another aspect of the invention, a flat, rectangular index photo is secured with respect to the card member. Such index photo has a length, measured parallel to the tray's longitudinal axis, which is greater (preferably, substantially greater) than the length of the blister member.

In yet another aspect of the invention, each of the storage tray's retention members includes a terminus and the barrier is adjacent to the terminii. That end of the tray opposite the barrier is open to receive the container. In a specific embodiment, the retention members comprise opposed, generally parallel, edges forming linear guide slots and the barrier comprises a receiving slot perpendicular to the guide slots. The container is inserted into the open end of the tray and moved along the tray until it abuts the barrier.

A highly preferred tray is made of thin, transparent, sheet-like plastic material. When manufacturing the tray, container retention members are formed by folding a portion of the tray's first edge over the body of the material toward the second edge and a portion of the second edge over the body of the material toward the first edge.

Once the retention members are formed, the barrier is formed by folding a portion of the sheet-like material toward that end of the body which is open in the finished tray. Considered another way, the barrier is formed by folding a portion of the material in a direction parallel to the edges. And it should be appreciated that each of the two retention members and the barrier can be formed in any order including simultaneously.

While a highly preferred tray is configured to store several containers, the avid photographer prefers that means be provided for storing several trays. Accordingly, the tray may be used in conjunction with a rectangular storage chest. Such storage chest has a cover and an interior compartment bounded by parallel, spaced-apart lateral end panels that are separated by a distance that is slightly greater than the length of the tray. When the chest is so configured, trays may be placed in the compartment with slight clearance.

It is to be appreciated that the tray and the container(s) stored therein have an aggregate thickness. The storage chest has parallel, spaced-apart front and rear walls and most preferably, the spacing between the walls is at least equal to three times the aggregate thickness of the container and tray. To state it another way, a preferred storage chest is dimensioned to accommodate at least three trays with containers secured thereon.

In another embodiment, the tray may be used in conjunction with a storage chest that contains at least one tray retaining box having first and second sides opposite one another and third and fourth sides perpendicular to the first and second sides, and a plurality of tray receiving partitions supported with respect to the first and second sides. In this embodiment, the trays are positioned in the tray receiving partitions within each retaining box. Such boxes are then stored in the interior compartment of the storage chest.

Another aspect of the invention involves a method for manufacturing the tray. Such method includes the steps of providing a tray blank made of flat sheet material having first and second edges and a substantially planar end. A portion of the first edge of the material is folded toward the second edge and a portion of the second edge is folded toward the first edge. Once this is accomplished, a portion of the material is doubled back toward that end of the material which is to be open in the finished tray. It is to be appreciated that folding and doubling back of portions may be done sequentially in any order, simultaneously or some combination thereof.

DETAILED DESCRIPTIONS OF PREFERRED EMBODIMENTS

Figure 1:
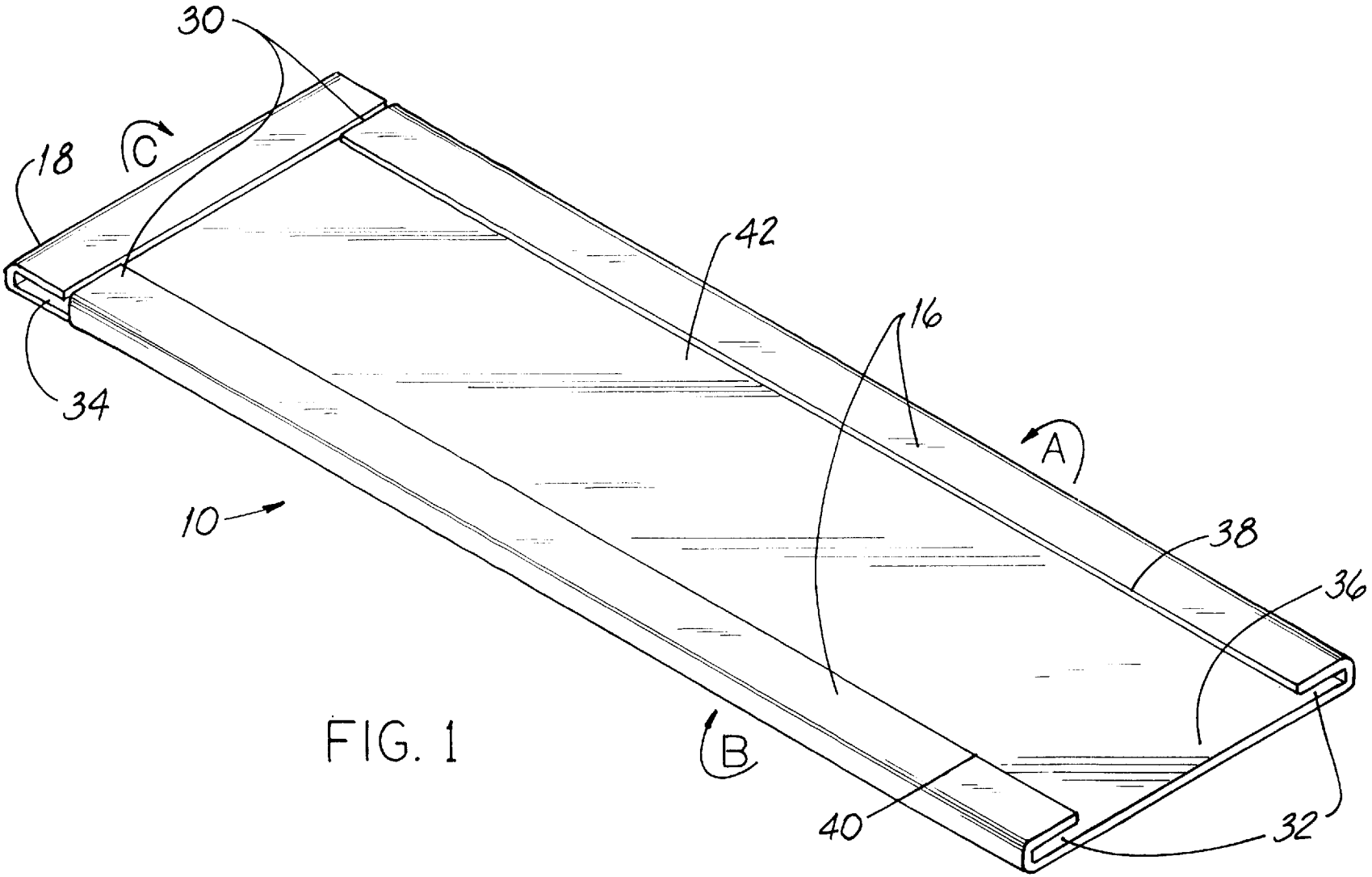
FIG. 1 is a perspective of the APS container storage tray.
Figure 3:
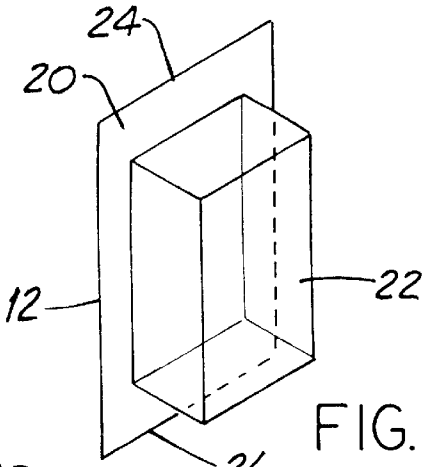
FIG. 3 is a perspective of the APS "blister pack" container.
Figure 2:
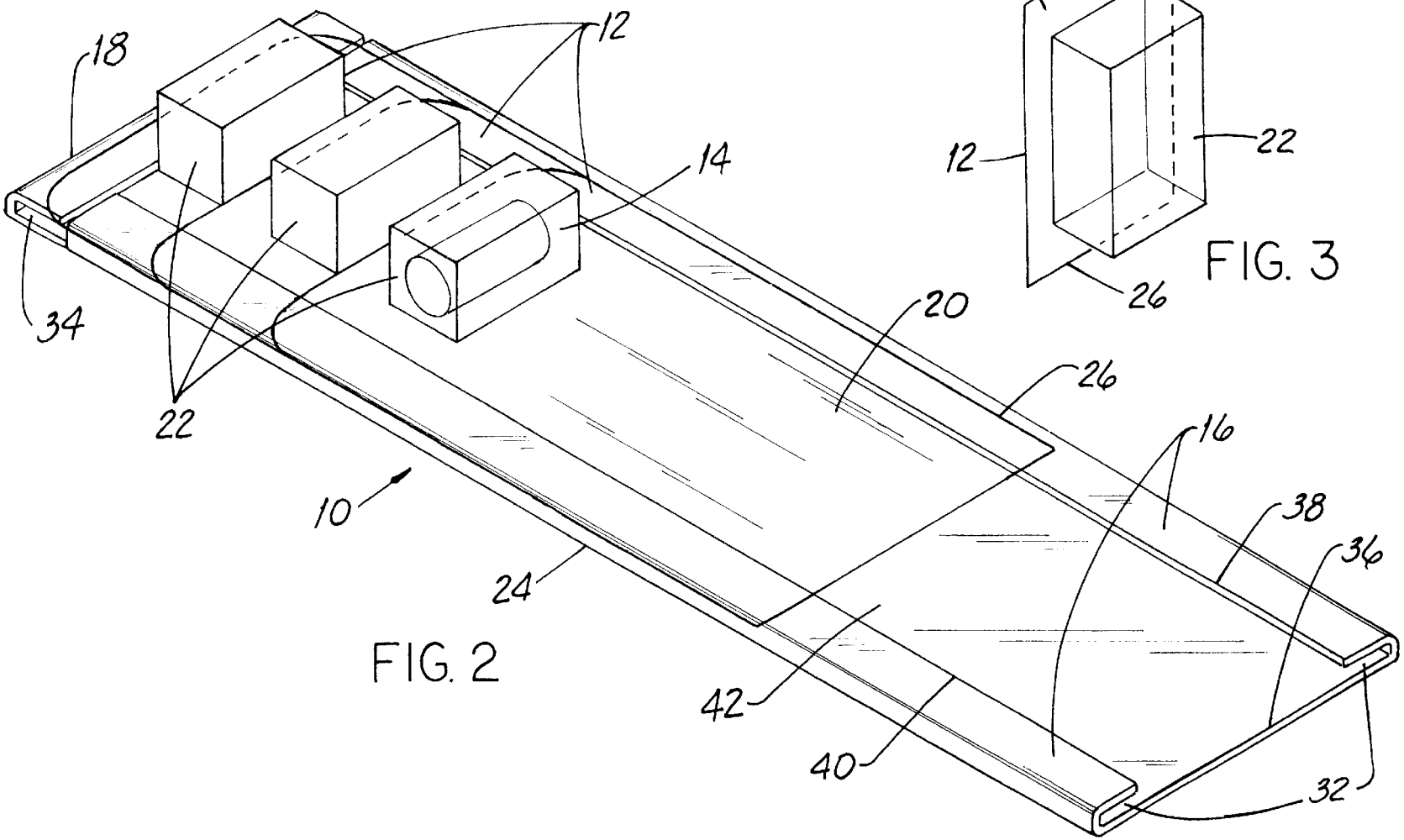
FIG. 2 is a perspective view of the APS container storage tray showing several containers affixed to respective card members stored in the tray.

FIG. 1 shows a tray 10 for storing a container 12, as shown in FIGS. 2 and 3, that is used to confine and store a film cartridge 14 of the type used in the Advanced Photo System. As seen in FIG. 1, the tray 10 is comprised of a plurality of retention members 16 that allow for sliding engagement of the tray 10 with the container 12. A barrier 18 for limiting sliding movement of such container 12 with respect to the tray 10 is also provided.

In a particular embodiment, the tray 10 is configured to receive and store a container 12 having a flat, rectangular card member 20 with a blister member 22 affixed thereto, thereby forming what may be termed a "blister pack." In this embodiment, the two long, parallel edges 24, 26 of the container 12 engage respective retention members 16 on the tray 10 for container 12 storage.

In a more preferred embodiment of the invention, as shown in FIGS. 2, the tray 10 has a longitudinal axis and the card member 20 has a width and a length, the latter measured parallel to the tray's 10 longitudinal axis. The blister member 22 also has a length and a width, and the length of the card member 20 is greater (preferably, substantially greater) than the length of the blister member 22.

Figure 4:
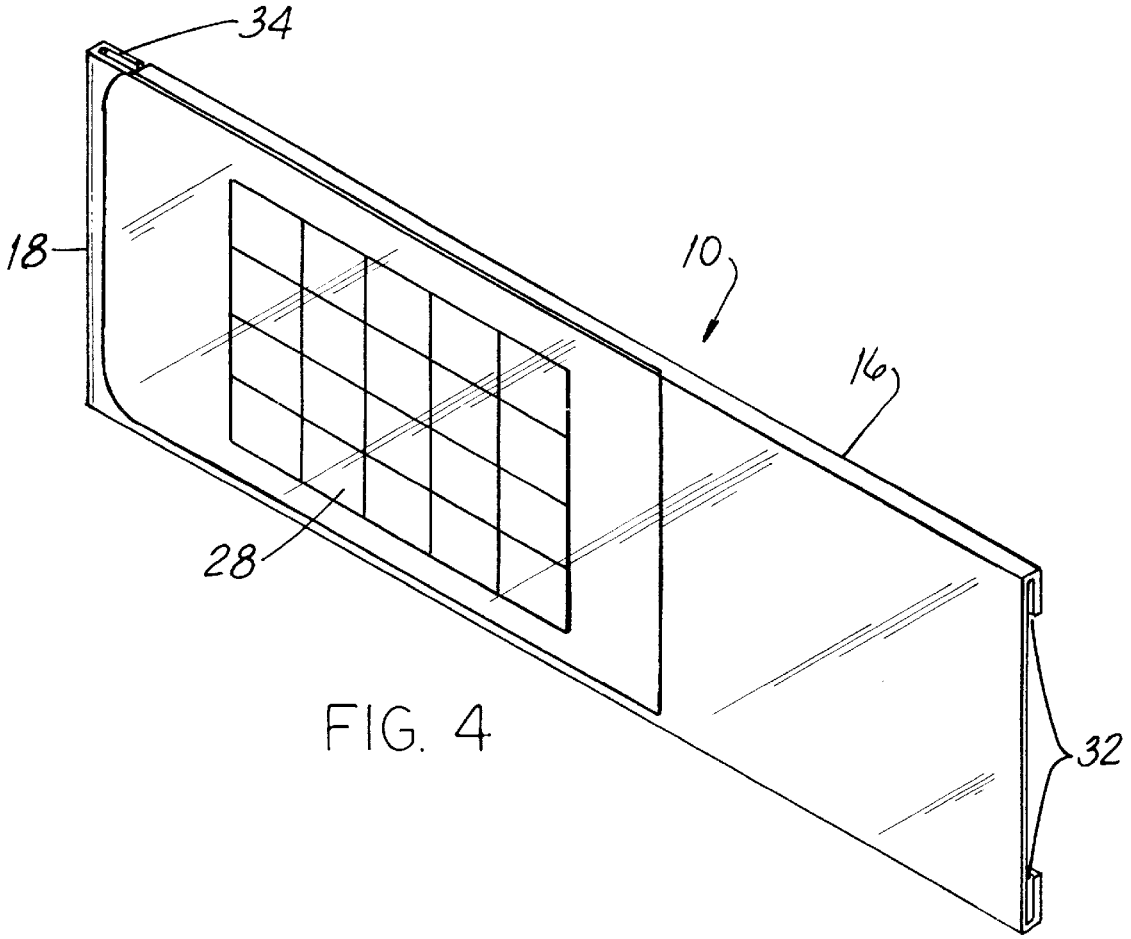
FIG. 4 is a perspective of the back side of the storage tray whereby the index print attached to the card member is visible.

FIG. 4 shows a specific version of the more preferred embodiment the invention. In such version, a flat, rectangular index photo 28 is secured with respect to the card member 20. Such index photo 28 has a length, measured parallel to the tray's longitudinal axis, which is greater (preferably, substantially greater) than the length of the blister member 22.

In yet another aspect of the invention, each of the storage tray's retention members 16 includes a terminus 30 and the barrier is adjacent to the terminii. That end of the tray 10 opposite the barrier 18 is open to receive the container 12. In a specific embodiment, the retention members 16 comprise opposed, generally parallel, edges forming linear guide slots 32 and the barrier 18 comprises a receiving slot 34 perpendicular to the guide slots 32. The container 12 is inserted into the open end 36 of the tray 10 and moved along the tray 10 until it abuts the barrier 18.

A highly preferred tray 10 is made of thin, transparent, sheet-like plastic material. The retention members 16 are embodied as respective portions of the tray's first and second edge 38, 40 overlapping the body 42 of the material. The barrier 18 is embodied as a portion of the sheet-like material doubled back toward that end of the body 42 which is open in the finished tray 10.

Figure 5:
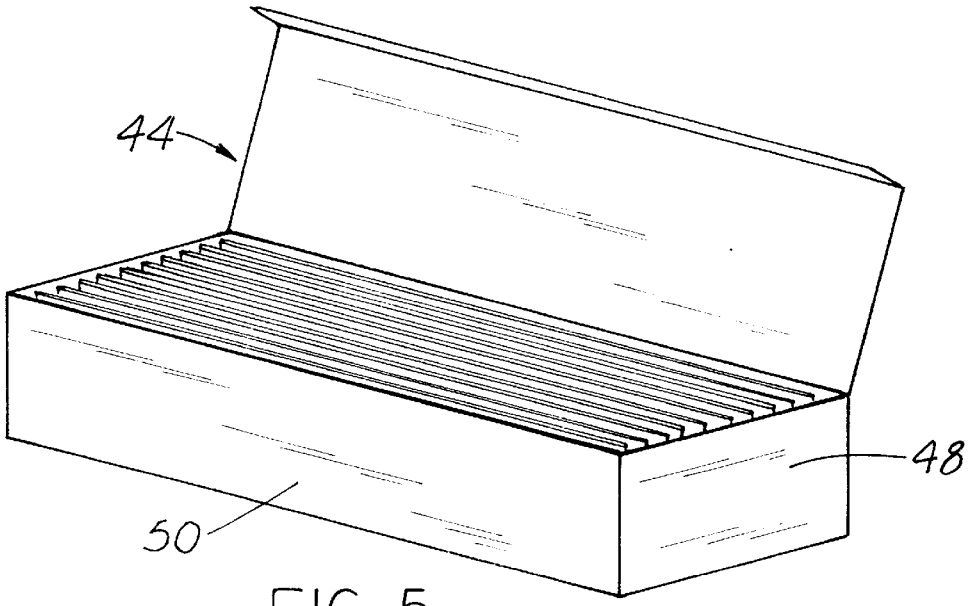
FIG. 5 is a perspective of the storage chest used to house the storage trays.

While a highly preferred tray 10 is configured to store several containers 12, the avid photographer prefers that means be provided for storing several trays 10. Accordingly, the tray 10 may be used in conjunction with a rectangular storage chest 44 as shown in FIG. 5. Such storage chest 44 has an interior compartment 46 bounded by parallel, spaced-apart lateral end panels 48 that are separated by a distance that is slightly greater than the length of the tray 10. When the chest 44 is so configured, trays 10 may be placed in the compartment 46 with slight clearance.

It is to be appreciated that the tray 10 and the container(s) 12 stored therein have an aggregate thickness. The storage chest 44 has parallel, spacedapart front and rear walls 50 and most preferably, the spacing between the walls 50 is at least equal to three times the aggregate thickness of the container 12 and tray 10.

Figure 6:
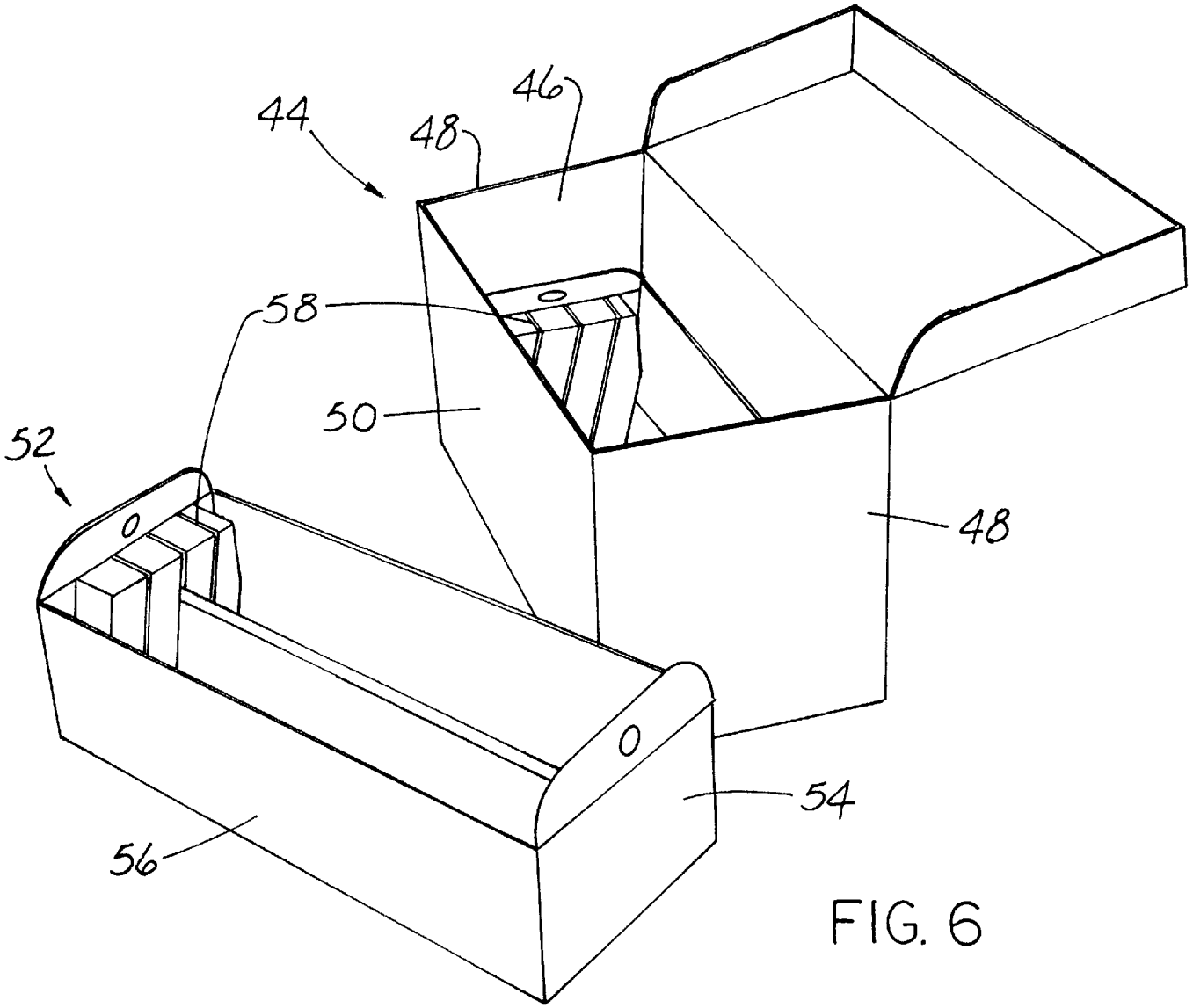
FIG. 6 is a perspective of a preferred embodiment of the storage chest at a perspective of a tray retaining box with receiving partitions supported with respect to the sides of the retaining box.

In another embodiment, as shown in FIG. 6, the tray 10 may be used in conjunction with a storage chest 44 that contains at least one tray retaining box 52 having first and second sides 54 opposite one another and third and fourth sides 56 perpendicular to the first and second sides 54, and a plurality of tray receiving partitions 58 supported with respect to the first and second sides 54. In this embodiment, the trays 10 are positioned in the tray receiving partitions 58 within each retaining box 52. Such boxes 52 are then stored in the interior compartment 46 of the storage chest 44.

Another aspect of the invention involves a method for manufacturing the tray 10 used to store a container 12 containing a film cartridge 14 such as the type used in the Advanced Photo System. Such method includes the steps of providing a tray blank made of flat sheet material having first and second edges 38, 40 and a substantially planar end. As represented by the arrow A, a portion of the first edge 38 of the material is folded toward the second edge 40 and, as represented by the arrow B, a portion of the second edge 40 is folded toward the first 38. To form the barrier 18, a portion of the material is doubled back toward that end of the material which is to be open in the finished tray 10. Such doubling back is represented by the arrow C. Considered another way, the barrier 18 is formed by folding a portion of the material in a direction parallel to the edges 38, 40.

While the principles of the invention have been shown and described in connection with but a few embodiments, it is to be understood clearly that such embodiments are by way of example and are not limiting.

What is claimed:

1. In combination, (a) a container housing an APS film cartridge used in the Advanced Photo System and having a substantially flat card member, and (b) a tray for storing the container, and wherein the tray comprises:

a substantially flat body;

a plurality of retention members for sliding engagement with the card member; and a barrier for limiting sliding movement of such card member with respect to the card member;

and wherein:

the tray has a lateral dimension;

the container includes a blister member having a lateral dimension, the blister member being affixed to the card member to form a blister pack; and the lateral dimension of the tray is greater than the lateral dimension of the blister member.

2. The combination of claim 1 wherein:

the card member has a length and width;

the blister member has a length and width; and the length of the card member is greater than the length of the blister member.

3. The combination of claim 2 wherein an index photo is secured with respect to the card member and such index photo has a length greater than the length of the blister member.

4. The tray of claim 1 wherein:

each of the retention members includes a terminus; and the barrier is adjacent to the terminii.

5. The tray of claim 4 wherein:

the retention members comprise opposed linear guide slots; and the barrier comprises a receiving slot perpendicular to the guide slots.

6. The combination of claim 1 wherein:

the tray is made of sheet-like material having a body and first and second body edges opposing one another;

the tray includes an open end;

the barrier is opposite the open end, and wherein the retention members include:

a portion of the sheet-like material folded over the body and toward the second edge, thereby forming a guide slot;

another portion of the sheet-like material folded over the body and toward the first edge, thereby forming another guide slot;

and wherein the barrier includes:

a portion of the sheet-like material folded over toward the open end.

7. The tray of claim 6 wherein the sheet-like material is transparent.

8. The combination of claim 1 in further combination with a storage chest wherein:

the storage chest has an interior compartment bounded by spaced-apart end panels;

the tray has a length;

the spacing between the end panels is slightly greater than the length, thereby permitting the tray to be placed in the compartment with slight clearance;

a container housing a film cartridge and an index print is mounted on the tray;

the container and tray have an aggregate thickness;

the storage chest has spaced-apart walls;

the spacing between the walls is at least equal to three times the aggregate thickness of the container and tray; and the storage chest has a plurality of tray receiving partitions supported with respect to the end panels.

9. In combination, (a) a tray for storing a container housing an APS film cartridge used in the Advanced Photo System and having a substantially flat card member, and (b) a tray storage chest, and wherein the tray comprises:

a substantially flat body;

a plurality of retention members for sliding engagement with the card member; and a barrier for limiting sliding movement of such card member with respect to the card member;

and wherein:

the storage chest has an interior compartment bounded by spaced-apart end panels;

the tray has a length;

the spacing between the end panels is slightly greater than the length, thereby permitting the tray to be placed in the compartment with slight clearance;

a container housing a film cartridge and an index print is mounted on the tray;

the container and tray have an aggregate thickness;

the storage chest has spaced-apart walls;

the spacing between the walls is at least equal to three times the aggregate thickness of the container and tray; and the storage chest has a plurality of tray receiving partitions supported with respect to the end panels.

* * * * *